US005248381A

United States Patent [19]

Dunker et al.

[11] Patent Number: 5,248,381

[45] Date of Patent: Sep. 28, 1993

[54] ETCH SOLUTION AND ASSOCIATED PROCESS FOR REMOVAL OF PROTECTIVE METAL LAYERS AND REACTION DEPOSITS ON TURBINE BLADES

[75] Inventors: Rolf-Jörg Dunker; Holger Polanetzki, both of Dachau; Martin Thoma, Munich, all of Fed. Rep. of Germany

[73] Assignee: MTU Motoren-und Turbinen- Union München GmbH, Munich, Fed. Rep. of Germany

[21] Appl. No.: 899,691

[22] Filed: Jun. 16, 1992

[30] Foreign Application Priority Data

Jun. 20, 1991 [DE] Fed. Rep. of Germany ..... 4120305

[51] Int. Cl.[5] ..... B44C 1/22; C23F 1/00

[52] U.S. Cl. ..... 156/637; 156/656; 156/664; 252/79.4; 134/3

[58] Field of Search ..... 156/637-639, 156/656, 664, 665; 252/79.1, 79.2, 79.4; 134/3, 34

[56] References Cited

U.S. PATENT DOCUMENTS

| | | | |
|---|---|---|---|
| 4,302,246 | 11/1981 | Brindisi et al. | 252/79.4 X |
| 4,425,185 | 1/1984 | Fishter et al. | 252/79.2 X |
| 4,525,250 | 6/1985 | Fahrmbacher-Lutz | 252/79.4 X |
| 4,944,807 | 7/1990 | Sova | 134/3 |

*Primary Examiner*—William A. Powell
*Attorney, Agent, or Firm*—Ladas & Parry

[57] ABSTRACT

An etch solution for the removal of metallic layers, which provide protection against corrosion by hot gases, and of deposits resulting from hot gas reactions on turbine blades in power units comprising a salt solution and an inhibitor. The salt solution consists of a hydrogen sulfate in the amount of 5 to 45% by weight and the inhibitor is present in the amount of 0.5 to 10% by weight. The total amount of the hydrogen sulfate and inhibitor is present with at least 50% by weight of water based on the total etch solution. Using this etch solution, layers preferably comprising MCrAlY are removed from turbine blades comprised of alloys of Ti, Co or Ni.

10 Claims, No Drawings

ETCH SOLUTION AND ASSOCIATED PROCESS FOR REMOVAL OF PROTECTIVE METAL LAYERS AND REACTION DEPOSITS ON TURBINE BLADES

FIELD OF THE INVENTION

The invention relates to an etch solution and to a process for the removal of metallic layers, which provide protection against corrosion by hot gases, and of the deposits resulting from hot gas reactions on turbine blades in power units using a solution containing salts and an inhibitor.

BACKGROUND AND PRIOR ART

Turbine blades in power units are made of alloys based on Ti, Ni or Co, and an aluminide layer is formed on the blades to protect them against corrosion by hot gases. The aluminide layer is removable in a process disclosed in U.S. Pat. No. 4,339,282. A disadvantage of the process in this patent and of the etch solution which is disclosed therein is that they cannot be used for protective metallic layers based on MCrAlY wherein M is a metal such as Co, Ni or Ta. These layers are characterized by their higher resistance to the corrosive attack of hot gases and to deposits deriving from hot gas reactions. However, the removal of such layers with known etch solutions for the removal of aluminide layers is not possible without considerable etching into, and removal of the material of the turbine blade. The composition of known etch solutions is based on a high proportion of pure acids such as nitric acid, fluoric acid, hydrochloric acid, sulfuric acid or mixtures of these together with small additions of salts, such as iron chloride or copper sulfate, and inhibitors which are intended to reduce etching into the material of the turbine blade.

SUMMARY OF THE INVENTION

An object of the invention is to provide an etch solution and an associated process for the removal of protective metallic layers, and of deposits formed by hot gas reactions, on turbine blades in power units. In this regard, coatings which are very resistant to corrosion by hot gases which are based on MCrAlY should, in particular, be removed without any remaining residues and without the basic material being attacked. In addition, diffusion zones near the surface between the material of the turbine blade and the protective coating are also to be removed at the same time as the removal of deposits on the protective coating formed by hot gas reactions during operation of the turbine blades in power units.

This object is accomplished by means of an etch solution comprising a salt solution and at least one inhibitor, the salt solution consisting of 5 to 45% by weight of a hydrogen sulfate and 0.5 to 10% by weight of the inhibitor, the total amount of hydrogen sulfate and inhibitor being present in at least 50% by weight of water based on the total etch solution.

A particular advantage of the etch solution of the invention is that it is completely free from acids so that, working with this etch solution and its disposal involve smaller problems as compared to the known etch solutions containing acids.

The danger of sulfating the surface of the turbine blades, as in the case of the addition of, for example, copper sulfate, is advantageously reduced as a result of using hydrogen sulfates.

The etch solution of the invention has the further advantage that not only can galvanically deposited metallic coatings comprising chromium, cadmium or MCrAlY be removed but also that low pressure and high pressure plasma-sprayed layers comprising MCrAlY or NiCr can be removed. Even slip-promoting lacquers, anti-diffusion layers, oxide layers of small thickness, for example, less than 1 μm, or deposits resulting from hot gas reactions can be removed with the etch solution in accordance with the invention without leaving any remaining residues.

In a preferred embodiment of the invention, the hydrogen sulfate is ammonium hydrogen sulfate, sodium hydrogen sulfate, potassium hydrogen sulfate or mixtures thereof. An advantage of these alkali metal hydrogen sulfates is that, compared to the alkaline earth sulfates, they provide higher rates of removal by a factor of at least 2. In addition, a marked reduction in the removal of the material of the turbine blades can also be observed.

Mixtures consisting, preferably, of alkyl sulfates, alkyl sulfonates, alkylaryl ethoxylates, polyglycols and polyglycol ethers, or products which are comparable in terms of their action, have proven valuable as inhibitors; these are available under the trade marks Actane AAA, Silvinol 85 or Rhodine 92. After removing the coatings and any diffusion zones under the coating, the inhibitors advantageously produce passivation of the surface of the turbine blade. The aforesaid inhibitors are present in the market as regular commercial products for chemical etching processes. However, they were not previously known for accomplishing the object of the present invention.

A preferred use of the etch solution comprises the removal of the sulfidation products which, during operation of the turbine blades in power units, are deposited in the form of a layer of reaction products on the metallic layer, consisting of MCrAlY, which provides protection against corrosion by hot gases. An advantage associated with this is that a separate etching or cleansing solution is not necessary for such deposits which are produced during operation.

Another object of the invention is to provide a process for the removal of protective metallic layers, and of deposits resulting from hot gas reactions with turbine blades in power units, and this object is satisfied by a process having the following steps:

a) protectively covering bare, non-coated regions of the turbine blade of a power unit;

b) activating the surface of the coated blade by removing any passivating deposits;

c) heating an etch solution to a temperature between 20° and 95° C.;

d) removing the metallic layer, which provides protection against corrosion by hot gases, and deposits resulting from hot has reactions by immersing the turbine blade in the heated etch solution for 2 to 10 hours with intensive agitation of the etch solution; and e) cleansing the surface of the component.

Since a turbine blade in a power unit has coated and uncoated surfaces, it is first necessary to protectively cover the uncoated surfaces with, for example, a lacquer which is resistant to the etch solution.

After operating the turbine blades of power units in a duct for hot gases in an aerodynamic engine, the surface of the turbine blade not only becomes covered with sulfidation products but also, predominantly, with passivating layers consisting of metallic oxides; the blades can be covered to a depth in excess of 1 μm. Such thick oxide layers are removed only slowly by the etch solution. There is, therefore, an activation step at the beginning of the process in which such passivating oxide layers are broken up mechanically by blasting in the wet state or they are dissolved chemically by means of reducing solutions.

The process has the advantage that layers which provide protection against corrosion by hot gases, preferably MCrAlY layers, and deposits resulting from hot gas reactions consisting of sulfidation products on turbine blades in power units can be removed gently from the turbine blades which comprise alloys based on Ti, Co or Ni. This gentle process of removal comprises the features that neither etching away of, nor etching into, the surface of the turbine blade occurs and that the surface of the turbine blade is freed from the coating without leaving any residues behind.

A preferred range for the temperature of the etch bath in this process is between 50° and 95° C. A lower range of temperature of the etch bath, between 20° and 50° C., is preferably used for the cleansing and removal procedures in regard to deposits resulting from hot gas reactions whereas an upper range of temperature, between 50° and 95° C., is advantageously employed for the removal of the metallic layers which provide the protection against corrosion by hot gases. It is therefore advantageous to hold the etch bath at the lower temperature, i.e. between 20° and 50° C., for ⅓ of the etching time and at the higher temperature, i.e. between 50° and 95° C., for ⅔ of the etching time.

DETAILED DESCRIPTION OF A PREFERRED EMBODIMENT

The invention will be described in greater with reference to the following example.

EXAMPLE

An etch solution is produced consisting of 100 to 850 g/l of a hydrogen sulfate, either ammonium hydrogen sulfate, sodium hydrogen sulfate or potassium hydrogen sulfate, and 1-20 g/l of an inhibitor comprising Actane AAA or Silvinol 85 or Rhodine 92 or a mixture of alkyl sulfates, alkyl sulfonates, alkylaryl ethoxylates, polyglycols and polyglycol ethers, the remainder being water. This etch solution is heated to a temperature between 20° and 95° C., preferably 50° to 95° C., and then, in this example, held at 70° C. After an activating treatment and protectively covering its non-coated surfaces, a turbine blade made of the material Rene 100 and having a MCrAlY coating is immersed in the etch bath maintained at a temperature of 70° C. The activating treatment in this example comprises wet blasting with ceramic spheres of $Al_2O_3$.

The turbine blade was taken out of the etch bath after 3 hours; it has a perfectly de-coated surface.

Such treatments of the coated surfaces of turbine blades are employed in the reconditioning and repair of power units.

Although the invention has been described in relation to a specific preferred embodiment thereof, it will become apparent to those skilled in the art that numerous modifications and variations can be made within the scope and spirit of the invention as defined in the attached claims.

The specific inhibitors used in the example with the hydrogen sulfate include the following:

| | |
|---|---|
| alkyl sulfate | 1 to 10 weight % |
| Alkyl sulfonate | 5 to 10 weight % |
| alkylaryl ethoxylate | 5 to 15 weight % |
| polyglycol | 5 to 15 weight % |
| polyglycol ether | 5 to 15 weight % |

We claim:

1. An etch solution for the removal of a metallic layer, which provides protection against corrosion by hot gases, and of deposits resulting from hot gas reactions on a turbine blade in a power unit, said solution comprising a salt solution and at least one inhibitor, said salt solution consisting essentially of 5 to 45% by weight of a hydrogen sulfate, said inhibitor being present in an amount of 0.5 to 10% by weight, the total amount of the hydrogen sulfate and inhibitor being present with at least 50% by weight of water.

2. An etch solution in accordance with claim 1, wherein said hydrogen sulfate is ammonium hydrogen sulfate, sodium hydrogen sulfate, potassium hydrogen sulfate or mixtures thereof.

3. An etch solution in accordance with claim 1, wherein said inhibitor comprises a mixture of alkyl sulfates, alkyl sulfonates, alkylaryl ethoxylates, polyglycols or polyglycol ethers.

4. An etch solution in accordance with claim 1, for the removal of protective metallic layers consisting of MCrAlY wherein M is Co, Ni or Ta.

5. An etch solution in accordance with claim 1, for the removal of sulfidation deposits resulting from hot gas reactions.

6. An etch solution in accordance with claim 1, wherein said salt solution consists of 100 to 850 g/l of ammonium hydrogen sulfate, sodium hydrogen sulfate or potassium hydrogen sulfate, 1 to 20 g/l of said inhibitor, the balance being water.

7. An etch solution in accordance with claim 6, wherein said inhibitor is an alkyl sulfate, an alkyl sulfonate, an alkylaryl ethoxylate, polyglycol or polyglycol ether.

8. A process for removing metallic protective layers and deposits resulting from hot gas reactions, from a turbine blade of a power unit, using an etch solution as claimed in claim 1, said process comprising:

a) covering any bare regions of the turbine blade with a protective coating resistant to said etch solution;
b) activating the surface of the blade by removing passivating deposits therefrom;
c) heating the etch solution to a temperature between 20° and 95° C.;
d) removing said metallic protective layers and said deposits resulting from hot gas reactions by immersing the turbine blade in the heated etch solution for 2 to 10 hours with intensive agitation of the etch solution; and
e) washing the surface of the blade.

9. A process in accordance with claim 8, wherein said etch bath is maintained at a temperature of 50° to 95° C.

10. A process in accordance with claim 8, wherein said etch solution is maintained at a temperature of between 20° and 50° C. for the first ⅓ of the time that the blade is immersed in the solution and at a temperature of between 50° and 95° C. for the second ⅔ of the time that the blade is immersed in the solution.

* * * * *